US011058281B2

(12) United States Patent
Fawaz et al.

(10) Patent No.: US 11,058,281 B2
(45) Date of Patent: Jul. 13, 2021

(54) DISHWASHER INCLUDING RACK POSITION SENSOR TO CONTROL CAPTURE OF RACK IMAGES BY A CAMERA

(71) Applicant: Midea Group Co., Ltd., Foshan (CN)

(72) Inventors: Bassam Fawaz, Louisville, KY (US); Robert M. Digman, Goshen, KY (US)

(73) Assignee: MIDEA GROUP CO., LTD., Guangdong (CN)

( * ) Notice: Subject to any disclaimer, the term of this patent is extended or adjusted under 35 U.S.C. 154(b) by 105 days.

(21) Appl. No.: 16/446,696

(22) Filed: Jun. 20, 2019

(65) Prior Publication Data

US 2020/0397216 A1 Dec. 24, 2020

(51) Int. Cl.

| | |
|---|---|
| ***A47L 15/42*** | (2006.01) |
| ***A47L 15/00*** | (2006.01) |
| ***A47L 15/46*** | (2006.01) |
| ***A47L 15/50*** | (2006.01) |

(52) U.S. Cl.

CPC ..... *A47L 15/4295* (2013.01); *A47L 15/0021* (2013.01); *A47L 15/4274* (2013.01); *A47L 15/46* (2013.01); *A47L 15/0002* (2013.01); *A47L 15/50* (2013.01); *A47L 2401/04* (2013.01)

(58) Field of Classification Search

CPC ..... A47L 15/00–508

See application file for complete search history.

(56) References Cited

U.S. PATENT DOCUMENTS

| | | | | |
|---|---|---|---|---|
| 7,621,605 | B2 | 11/2009 | Bond et al. | |
| 7,842,137 | B2 | 11/2010 | Classen et al. | |
| 7,935,194 | B2 | 5/2011 | Rolek | |
| 8,220,472 | B2 | 7/2012 | Kaczmarek | |
| 8,696,827 | B2 | 4/2014 | Ashrafzadeh et al. | |
| 9,610,000 | B2 | 4/2017 | Rehm et al. | |
| 9,901,240 | B2 | 2/2018 | Lee | |
| 10,080,477 | B2 | 9/2018 | Fauth et al. | |
| 2006/0119236 | A1* | 6/2006 | Dickson | A47L 15/504 312/311 |
| 2010/0126526 | A1 | 5/2010 | Poyner et al. | |
| 2010/0170544 | A1* | 7/2010 | Casonato | B08B 3/024 134/137 |
| 2012/0138092 | A1* | 6/2012 | Ashrafzadeh | A47L 15/4295 134/18 |
| 2013/0268134 | A1* | 10/2013 | Tuller | F24C 3/124 700/291 |

(Continued)

FOREIGN PATENT DOCUMENTS

| | | | |
|---|---|---|---|
| DE | 102012209679 | A1 | 12/2013 |
| DE | 102014213418 | A1 | 1/2016 |

(Continued)

*Primary Examiner* — Michael E Barr
*Assistant Examiner* — Omair Chaudhri
(74) *Attorney, Agent, or Firm* — Middleton Reutlinger

(57) ABSTRACT

A dishwasher utilizes one or more sensors capable of detecting when a rack is at an operative position at which the rack is positioned within the wash tub during washing and/or an extended position at which at least a portion of the rack is extended beyond the wash tub for loading or unloading of utensils, thereby allowing image captures by a camera to be timed relative to the movement of the rack into, between and/or away from the operative and/or extended positions.

18 Claims, 4 Drawing Sheets

(56) References Cited

U.S. PATENT DOCUMENTS

| | | | | |
|---|---|---|---|---|
| 2014/0145573 | A1* | 5/2014 | Cox | A47L 15/507 312/228.1 |
| 2014/0230865 | A1* | 8/2014 | Rehm | A47L 15/4293 134/56 D |
| 2016/0324396 | A1 | 11/2016 | Hong et al. | |
| 2017/0202426 | A1 | 7/2017 | Bosen et al. | |
| 2018/0168425 | A1 | 6/2018 | Wilson et al. | |
| 2019/0200841 | A1* | 7/2019 | Yoshimoto | G06T 7/74 |
| 2019/0290097 | A1* | 9/2019 | Naik | A47L 15/4282 |
| 2019/0343367 | A1* | 11/2019 | Jung | A47L 15/50 |
| 2020/0138261 | A1* | 5/2020 | Terradez Alemany | A47L 15/42 |

FOREIGN PATENT DOCUMENTS

| | | | | | |
|---|---|---|---|---|---|
| EP | 1192893 | A2 | | 4/2002 | |
| EP | 3427630 | A1 | | 1/2019 | |
| JP | 2003235781 | A | * | 8/2003 | A47L 15/0028 |
| WO | WO2017200680 | A1 | | 11/2017 | |
| WO | WO2017202574 | A1 | | 11/2017 | |
| WO | WO2018044094 | A1 | | 3/2018 | |
| WO | WO2018128258 | A1 | | 7/2018 | |
| WO | WO2019015996 | A1 | | 1/2019 | |

* cited by examiner

DISHWASHER INCLUDING RACK POSITION SENSOR TO CONTROL CAPTURE OF RACK IMAGES BY A CAMERA

BACKGROUND

Many modern dishwashers have various types of systems and sensors designed to provide superior cleaning of dirty dishes during a wash operation. It has been proposed, for example, to utilize an image sensor to capture images of the contents of each rack of a dishwasher prior to a wash operation to enable the wash operation to be optimized based upon the quantity, types and/or locations of utensils loaded into the dishwasher. Capturing quality images of the racks at appropriate points in time in order to accurately assess the contents of the racks, however, has proven to be problematic.

SUMMARY

The herein-described embodiments address these and other problems associated with the art by providing a dishwasher that utilizes one or more sensors capable of detecting when a rack is at an operative position at which the rack is positioned within the wash tub during washing and/or an extended position at which at least a portion of the rack is extended beyond the wash tub for loading or unloading of utensils, thereby allowing image captures by a camera to be timed relative to the movement of the rack into, between and/or away from the operative and/or extended positions.

Therefore, consistent with one aspect of the invention, a dishwasher may include a wash tub, a rack disposed in the wash tub and configured to support a plurality of utensils to be washed, the rack being movable between first and second positions, one of the first and second positions being an operative position at which the rack is positioned within the wash tub during washing and the other of the first and second positions being an extended position at which at least a portion of the rack is extended beyond the wash tub for loading or unloading of utensils, a camera directed toward the rack when the rack is disposed in one of the first and second positions, a sensor configured to detect when the rack is at one of the first and second positions, and a controller coupled to the camera and the sensor, the controller configured to detect that the rack is at one of the first and second positions using the sensor and in response thereto cause the camera to capture an image of the rack, the controller further configured to control one or more settings during a wash operation using the captured image.

In some embodiments, the rack has a range of travel, and the first and second positions are disposed at opposite ends of the range of travel of the rack. Also, in some embodiments, the sensor includes a magnetic sensor disposed on a wall of the wash tub. Further, in some embodiments, the magnetic sensor includes a hall effect sensor. In some embodiments, the rack includes a magnetic member disposed thereon and positioned to oppose the magnetic sensor at one of the first and second positions. In addition, in some embodiments, the rack includes a plurality of wheels, and the magnetic member is disposed on one of the plurality of wheels. In some embodiments, the rack is height-adjustable between first and second heights, and the magnetic sensor is dimensioned to detect the magnetic member when the rack is at each of the first and second heights.

In addition, in some embodiments, the sensor is a first sensor configured to detect when the rack is at the first position, and the dishwasher further includes a second sensor configured to detect when the rack is at the second position. Moreover, in some embodiments, the rack is a first rack, the sensor is a first sensor configured to detect when the first rack is at one of the first and second positions, and the dishwasher further includes a second rack being movable between third and fourth positions, one of the third and fourth positions being an operative position at which the second rack is positioned within the wash tub during a washing operation and the other of the third and fourth positions being an extended position at which at least a portion of the second rack is extended beyond the wash tub for loading or unloading of utensils, and a second sensor configured to detect when the second rack is at one of the first and second positions. Some embodiments may also include a door closing the wash tub and a door switch configured to detect when the door is closed, where the controller is further coupled to the door switch to detect whether the door is closed and to activate the camera and the sensor in response to detecting that the door has been opened.

In some embodiments, the first position is the extended position, the camera is directed toward the rack when the rack is disposed in the first position, the sensor is configured to detect when the rack is at the first position, and the controller is configured to cause the camera to capture the image of the rack in response to detecting that the rack is at the first position using the sensor.

Moreover, in some embodiments, the first position is the operative position and the second position is the extended position, the camera is directed toward the rack when the rack is disposed in the second position, the sensor is configured to detect when the rack is at the first position, and the controller is configured to cause the camera to capture the image of the rack in response to detecting that the rack is no longer at the first position using the sensor. In some embodiments, the controller is configured to cause the camera to capture the image of the rack in response to detecting that the rack is no longer at the first position by causing the camera to capture the image of the rack a predetermined delay after detecting that the rack is no longer at the first position.

In addition, in some embodiments, the first position is the operative position, where the camera is directed toward the rack when the rack is disposed in the first position, the sensor is configured to detect when the rack is at the first position, and the controller is configured to cause the camera to capture the image of the rack in response to detecting that the rack is at the first position using the sensor. Some embodiments may also include a light source disposed in the wash tub, and the controller is configured to activate the light source to illuminate the wash tub when the camera captures the image.

Moreover, in some embodiments, the controller is further configured to cause the camera to capture the image of the rack in response to detecting with the sensor that the rack has left the operative position and has thereafter returned to the operative position. Also, in some embodiments, the controller is configured to control the one or more settings during the wash operation by controlling one or more of a duration, a number of cycles, a cycle duration, a wash temperature, a cycle type, a spray direction, or a detergent amount.

In some embodiments, the controller is configured to cause the camera to capture an image in response to detecting with the sensor that the rack has entered the first or second position. In addition, in some embodiments, the controller is configured to cause the camera to capture an image in response to detecting with the sensor that the rack has left the first or second position.

Consistent with another aspect of the invention, a method is provided for operating a dishwasher of a type including a wash tub and a rack disposed in the wash tub and configured to support a plurality of utensils to be washed, where the rack is movable between first and second positions, one of the first and second positions being an operative position at which the rack is positioned within the wash tub during a washing and the other of the first and second positions being an extended position at which at least a portion of the rack is extended beyond the wash tub for loading or unloading of utensils. The method includes, in a controller of the dishwasher, detecting when the rack is at one of the first and second positions using a sensor, in response thereof, causing a camera directed toward the rack when the rack is disposed in one of the first and second positions to capture an image of the rack, and controlling one or more settings during a wash operation using the captured image.

Also, in some embodiments, the first position is the extended position, the camera is directed toward the rack when the rack is disposed in the first position, the sensor is configured to detect when the rack is at the first position, and causing the camera to capture the image of the rack is performed in response to detecting that the rack is at the first position.

Moreover, in some embodiments, the first position is the operative position and the second position is the extended position, the camera is directed toward the rack when the rack is disposed in the second position, the sensor is configured to detect when the rack is at the first position, and causing the camera to capture the image of the rack is performed in response to detecting that the rack is no longer at the first position.

Further, in some embodiments, the first position is the operative position, the camera is directed toward the rack when the rack is disposed in the first position, the sensor is configured to detect when the rack is at the first position, and causing the camera to capture the image of the rack is performed in response to detecting that the rack is at the first position.

These and other advantages and features, which characterize the invention, are set forth in the claims annexed hereto and forming a further part hereof. However, for a better understanding of the invention, and of the advantages and objectives attained through its use, reference should be made to the Drawings, and to the accompanying descriptive matter, in which there is described example embodiments of the invention. This summary is merely provided to introduce a selection of concepts that are further described below in the detailed description, and is not intended to identify key or essential features of the claimed subject matter, nor is it intended to be used as an aid in limiting the scope of the claimed subject matter.

DETAILED DESCRIPTION

Figure 1:
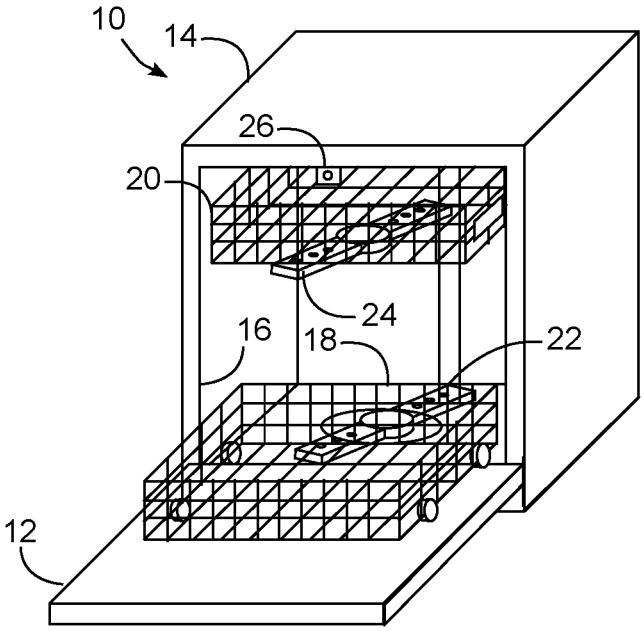
FIG. 1 is a perspective view of a dishwasher consistent with some embodiments of the invention.

Turning now to the drawings, wherein like numbers denote like parts throughout the several views, FIG. 1 illustrates an example dishwasher 10 in which the various technologies and techniques described herein may be implemented. Dishwasher 10 is a residential-type built-in dishwasher, and as such includes a front-mounted door 12 that provides access to a wash tub 16 housed within the cabinet or housing 14. Door 12 is generally hinged along a bottom edge and is pivotable between the opened position illustrated in FIG. 1 and a closed position (not shown). When door 12 is in the opened position, access is provided to one or more sliding racks, e.g., lower rack 18 and upper rack 20, within which various utensils are placed for washing. Lower rack 18 may be supported on rollers, while upper rack 20 may be supported on side rails, and each rack is movable between extended (loading/unloading) and operative (retracted) positions along a substantially horizontal direction. One or more rotating spray arms, e.g., lower spray arm 22 and upper spray arm 24, may also be provided to direct a spray of wash fluid onto utensils, e.g., upwardly into the respective rack 18, 20 under which is spray arm is disposed, although additional and/or other types of sprayers may be used in other embodiments. A camera 26 may also be disposed in wash tub 16 to capture an image of either rack 18, 20.

Control over dishwasher 10 by a user is generally managed through a control panel (not shown in FIG. 1) typically disposed on a top or front of door 12, and it will be appreciated that in different dishwasher designs, the control panel may include various types of input and/or output devices, including various knobs, buttons, lights, switches, textual and/or graphical displays, touch screens, etc. through which a user may configure one or more settings and start and stop a wash cycle.

The embodiments discussed hereinafter will focus on the implementation of the hereinafter-described techniques within a hinged-door dishwasher. However, it will be appreciated that the herein-described techniques may also be used in connection with other types of dishwashers in some embodiments. For example, the herein-described techniques may be used in commercial applications in some embodiments. Moreover, at least some of the herein-described techniques may be used in connection with other dishwasher configurations, including dishwashers utilizing sliding drawers, whereby the racks may be integrated with the drawers.

Figure 2:
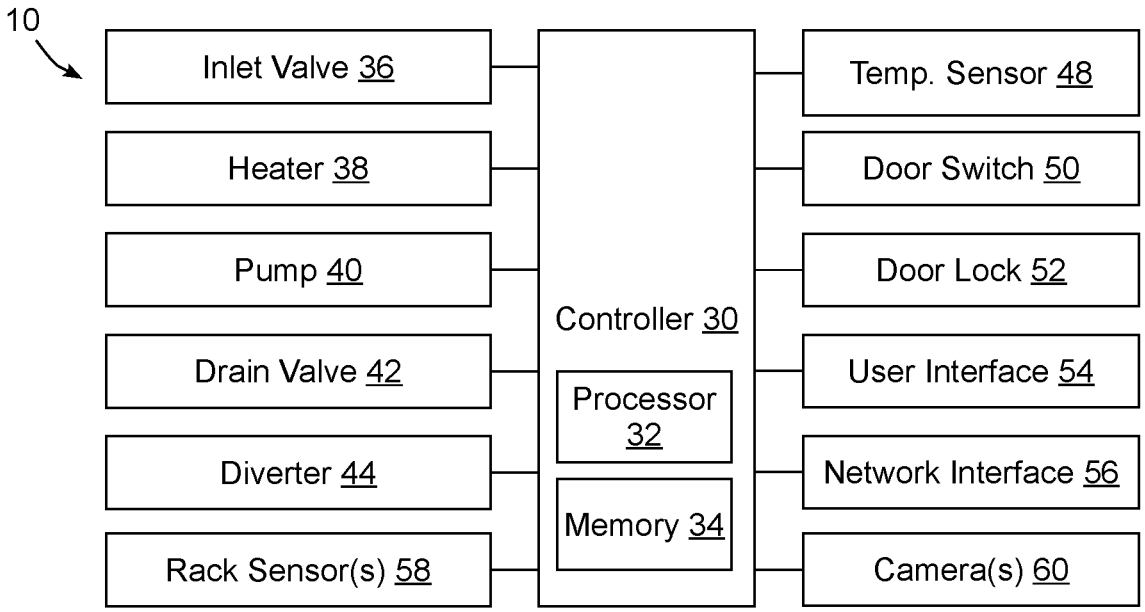
FIG. 2 is a block diagram of an example control system for the dishwasher of FIG. 1.

Now turning to FIG. 2, dishwasher 10 may be under the control of a controller 30 that receives inputs from a number of components and drives a number of components in response thereto. Controller 30 may, for example, include one or more processors 32 and a memory 34 within which may be stored program code for execution by the one or more processors. The memory may be embedded in controller 30, but may also be considered to include volatile and/or non-volatile memories, cache memories, flash memories, programmable read-only memories, read-only memories, etc., as well as memory storage physically located elsewhere from controller 30, e.g., in a mass storage device or on a remote computer interfaced with controller 30.

As shown in FIG. 2, controller 30 may be interfaced with various components, including an inlet valve 36 that is coupled to a water source to introduce water into wash tub 16, which when combined with detergent, rinse agent and/or other additives, forms various fluids. Controller may also be coupled to a heater 38 that heats fluids, a pump 40 that recirculates fluid within the wash tub by pumping fluid to the wash arms and other spray devices in the dishwasher, a drain valve 42 that is coupled to a drain to direct fluids out of the dishwasher, and a diverter 44 that controls the routing of pumped fluid to different wash arms and/or other sprayers during a wash cycle. In some embodiments, a single pump 40 may be used, and drain valve 42 may be configured to direct pumped fluid either to a drain or to the diverter 44 such that pump 40 is used both to drain fluid from the dishwasher and to recirculate fluid throughout the dishwasher during a wash cycle. In other embodiments, separate pumps may be used for draining the dishwasher and recirculating fluid. Diverter 44 in some embodiments may be a passive diverter that automatically sequences between different outlets, while in some embodiments diverter 40 may be a powered diverter that is controllable to route fluid to specific outlets on demand. Generally, pump 40 may be considered to be a fluid supply in some embodiments as pump 40 supplies a pressurized source of fluid to diverter 40 for distribution to one or more spray arms and/or sprayers.

Controller 30 may also be coupled to a dispenser (not shown) to trigger the dispensing of detergent and/or rinse agent into the wash tube at appropriate points during a wash cycle. Additional sensors and actuators may also be used in some embodiments, including a temperature sensor 48 to determine a fluid temperature, a door switch 50 to determine when door 12 is latched, and a door lock 52 to prevent the door from being opened during a wash cycle. Moreover, controller 30 may be coupled to a user interface 54 including various input/output devices such as knobs, dials, sliders, switches, buttons, lights, textual and/or graphics displays, touch screen displays, speakers, image capture devices, microphones, etc. for receiving input from and communicating with a user. In some embodiments, controller 30 may also be coupled to one or more network interfaces 56, e.g., for interfacing with external devices via wired and/or wireless networks such as Ethernet, Bluetooth, NFC, cellular and other suitable networks. Additional components may also be interfaced with controller 30, as will be appreciated by those of ordinary skill having the benefit of the instant disclosure.

Moreover, in some embodiments, at least a portion of controller 30 may be implemented externally from a dishwasher, e.g., within a mobile device, a cloud computing environment, etc., such that at least a portion of the functionality described herein is implemented within the portion of the controller that is externally implemented. In some embodiments, controller 30 may operate under the control of an operating system and may execute or otherwise rely upon various computer software applications, components, programs, objects, modules, data structures, etc. In addition, controller 30 may also incorporate hardware logic to implement some or all of the functionality disclosed herein. Further, in some embodiments, the sequences of operations performed by controller 30 to implement the embodiments disclosed herein may be implemented using program code including one or more instructions that are resident at various times in various memory and storage devices, and that, when read and executed by one or more hardware-based processors, perform the operations embodying desired functionality. Moreover, in some embodiments, such program code may be distributed as a program product in a variety of forms, and that the invention applies equally regardless of the particular type of computer readable media used to actually carry out the distribution, including, for example, non-transitory computer readable storage media. In addition, it will be appreciated that the various operations described herein may be combined, split, reordered, reversed, varied, omitted, parallelized and/or supplemented with other techniques known in the art, and therefore, the invention is not limited to the particular sequences of operations described herein.

Controller 30 may also be coupled to one or more rack sensors 58 and one or more cameras 60, the configuration and use of which are discussed in greater detail below.

Numerous variations and modifications to the dishwasher illustrated in FIGS. 1-2 will be apparent to one of ordinary skill in the art, as will become apparent from the description below. Therefore, the invention is not limited to the specific implementations discussed herein.

Dishwasher with Rack Position Sensor to Control Capture of Rack Images by a Camera Now turning to FIGS. 3-8, in some embodiments, a dishwasher may utilize a rack position sensor in combination with a camera to capture images of a rack that may be used to optimize the wash operation of a dishwasher, e.g., by controlling one or more settings of the dishwasher. In particular, one or more sensors in a dishwasher may be capable of detecting when a rack is either at an operative position, where the rack is positioned within the wash tub during washing, or at an extended position at which at least a portion of the rack is extended beyond the wash tub for loading or unloading of utensils. The sensors may be used, for example, to allow image captures by a camera to be timed relative to the movement of the rack into, between and/or away from the operative and/or extended positions. For example, a rack position sensor may be used to detect when a rack has entered an operative or an extended position, when the rack has left the operative or the extended position, or when the rack has left and returned to the operative or the extended position. In some embodiments, a rack has a range of travel beyond which the rack cannot move, and the operative and extended positions of the rack correspond to the opposite ends of the range of travel of the rack.

Figure 3:
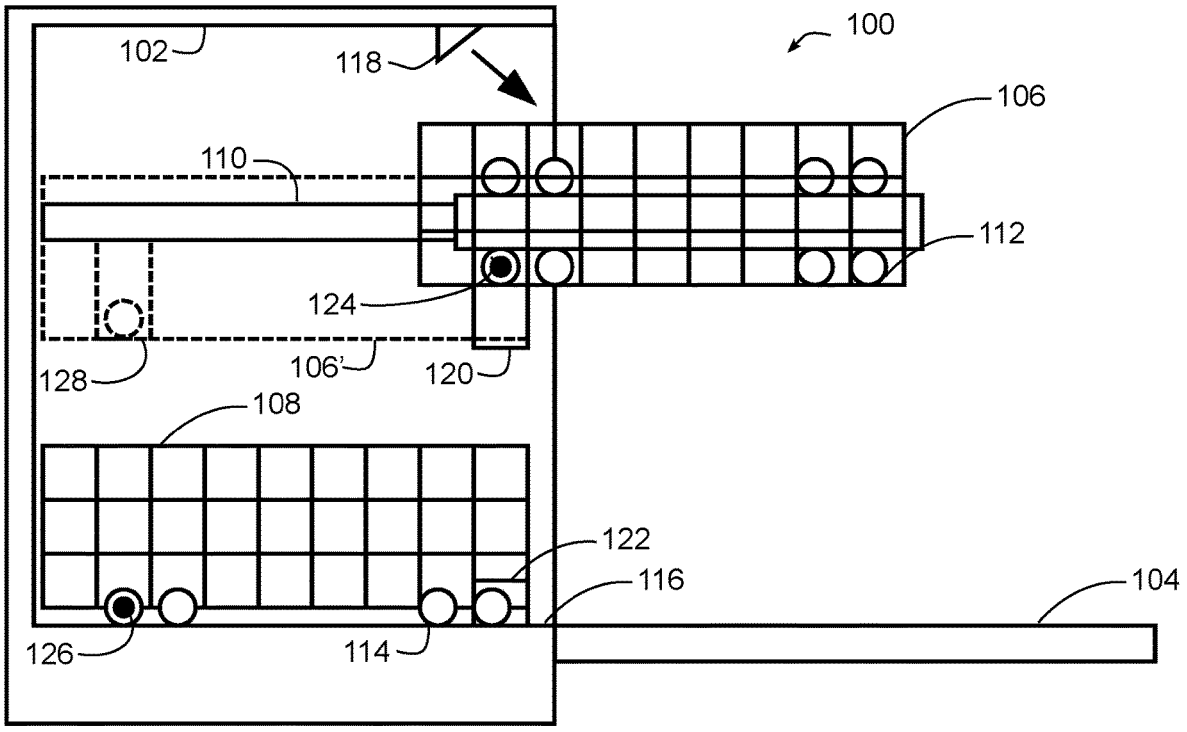
FIG. 3 is a functional side view of one example implementation of a dishwasher incorporating a rack sensor and camera configured to sense when a rack is at an extended position and capture an image of the rack when the rack is in the extended position, consistent with some embodiments of the invention.
Figure 4:
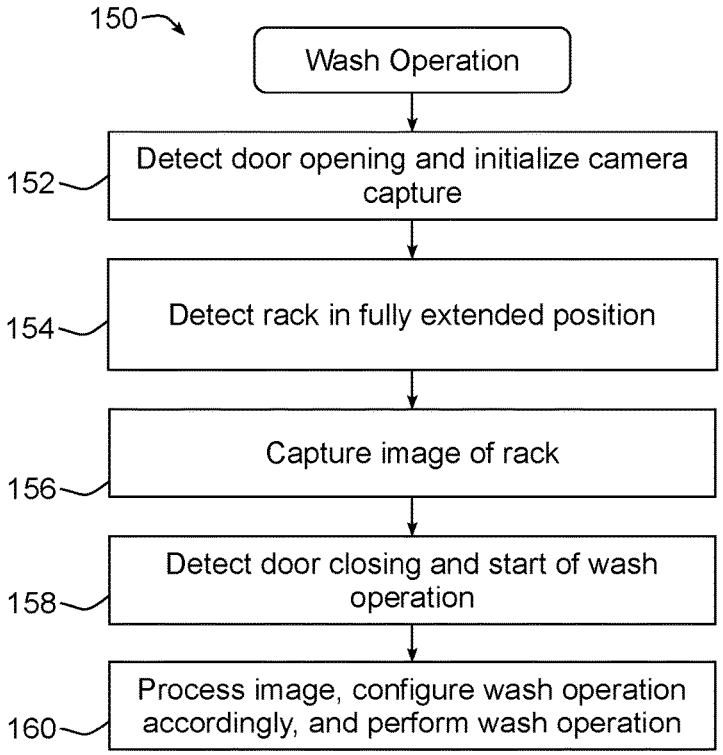
FIG. 4 is a flowchart illustrating an example sequence of operations for operating the dishwasher of FIG. 3.

FIG. 3, for example, illustrates an example dishwasher 100 including a wash tub 102, a door 104, and upper and lower racks 106, 108. Upper rack 106 is mounted on extendible rails 110 and includes a plurality of wheels 112 that ride along rails 110. Lower rack 108 has a plurality of wheels 114 that generally support the rack on a ledge 116 defined on wash tub 102 and the inner surface of door 104. In this figure, upper rack 106 is illustrated in its extended position, while lower rack 108 is illustrated in its operative position.

Dishwasher 100 also includes a camera 118 that has a field of view oriented to capture an image of either rack 106, 108 when that rack is in its extended position. Furthermore, dishwasher 100 includes upper and lower sensors 120, 122 respectively configured to detect a position of racks 106, 108.

In the illustrated embodiment, each sensor 120, 122 is mounted on a wall of wash tub 102, and each is configured as a magnetic sensor, e.g., a hall effect sensor, and a corresponding magnetic member 124, 126, is disposed on each rack 106, 108 and is positioned to oppose its respective sensor 120, 122 when its respective rack is at the extended position. While magnetic members 124, 126 may be disposed on other structures of a rack (e.g., on a wall of the rack, or on the slide to which the rack is connected, in the illustrated embodiments magnetic members 124, 126 are disposed on one of wheels 112, 114. It will also be appreciated that in some dishwasher designs, the upper rack may be height-adjustable between different heights, and as such, it may be desirable for sensor 120 to be dimensioned to detect magnetic member 124 when rack 106 is at its different heights (a lowered height for rack 106 is illustrated in phantom at 106' in FIG. 3).

Note that in this implementation, sensors 120, 122 are positioned such that the sensors can detect only when a rack 106, 108 is disposed in the extended position. Thus, as illustrated in FIG. 3, sensor 120 would detect that rack 106 is currently in the extended position due to the proximity of magnetic member 124, while sensor 122 would detect that rack 108 is not currently in the extended position due to the absence of magnetic member 126 in proximity to sensor 122. In some embodiments it may be desirable to detect both operative and extended positions, and as such, multiple sensors may be used to detect multiple positions of the rack, as represented in phantom by sensor 128.

A wash operation may be performed in dishwasher 100, for example, using sequence of operations 150 performed by a controller (e.g., controller 30 discussed above) and illustrated in FIG. 4. First, in block 152, opening of the door may be detected, causing the sensors 120, 122 and the camera 118 to be initialized. At this time, camera 118 may begin capturing images and storing the images in a buffer.

Next, in block 154, either of racks 106, 108 is detected as being in a fully extended position by the appropriate sensor 120, 122, and in block 156, an image of the rack is captured responsive to this detection. By doing so, the contents of the rack may be determined prior to washing, and thus, in some embodiments, image capture may be immediate upon detection, or may be deferred for some period of time to enable a user to load utensils into the rack. In sill other instances, it may be desirable to wait until detecting that the rack has left the extended position, i.e., just as the user has begun to push the rack back into the wash tub. By virtue of buffering captured images, a controller may, in such instances, go back to a prior captured image, e.g., the last image captured before the movement of the rack away from the extended position was detected.

It will also be appreciated that the sequence of blocks 154, 156 may be repeated multiple times, corresponding to the presence of multiple racks, as well as the possibility that a rack may be pulled out multiple times as additional utensils are added to both racks. In such instances, captured images may be maintained for both racks, and whenever a rack is extended, a newly captured image may replace the previously captured image for that rack, such that whenever a rack is pushed back into the wash tub, the most recent captured image for that rack is maintained.

Next, in block 158, closing of the door is detected along with a subsequent command to start the wash operation, and control passes to block 160. In block 160, the most recent captured image for each rack is processed to determine one or more of the quantity, type and/or locations of utensils in the rack, the wash operation is configured accordingly, and the wash operation is initiated and performed using the settings configured for the wash operation.

It will be appreciated that various techniques may be used to process the captured image of a rack, including for example local processing by the dishwasher, processing by a remote service, processing by a connected device, etc. Processing may implement machine learning techniques in some embodiments, and such techniques may be configured to detect, for example, the locations of utensils in a rack, the quantity of utensils in a rack, the types of utensils in a rack, or even the orientations of utensils in a rack (e.g., to detect whether a cup or bowl is faced up or down). In some embodiments, soiling of utensils may be detected to determine the relative soil level in the rack or particular utensils needing additional attention during a wash operation.

Configuration of a wash operation may include the control over one or more settings of the dishwasher, e.g., a wash operation duration, a number of cycles (e.g., rinse, wash, soak, drying cycles), a cycle duration, a wash temperature, a cycle type (e.g., normal, pot scrubber, gentle, quick wash, etc.), a spray direction (e.g., to focus on areas containing utensils, to ignore areas without utensils, to focus on heavily soiled utensils, etc.), or a detergent amount (e.g., where an automatic dispenser is present). Other configurations or settings may also be varied based upon the load characteristics sensed from the captured images, so the invention is not limited to this particular list.

Figure 5:
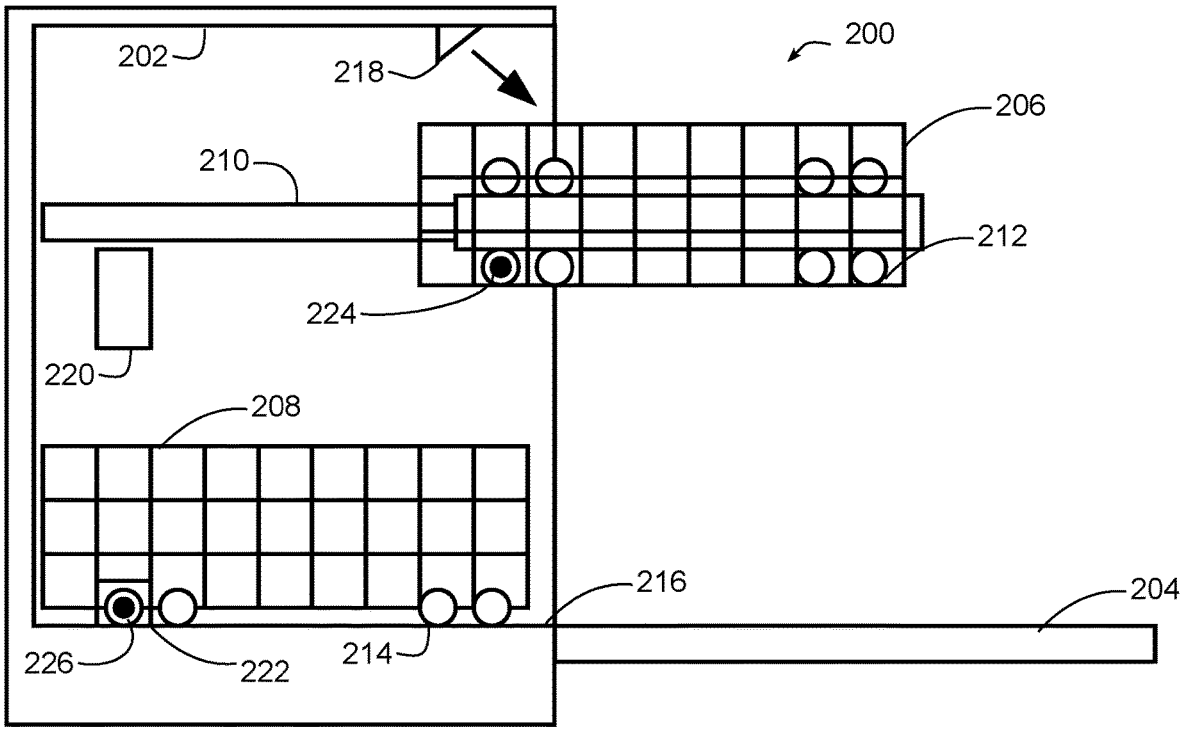
FIG. 5 is a functional side view of another example implementation of a dishwasher incorporating a rack sensor and camera configured to sense when a rack is at an operative position and capture an image of the rack when the rack is in an extended position, consistent with some embodiments of the invention.
Figure 6:
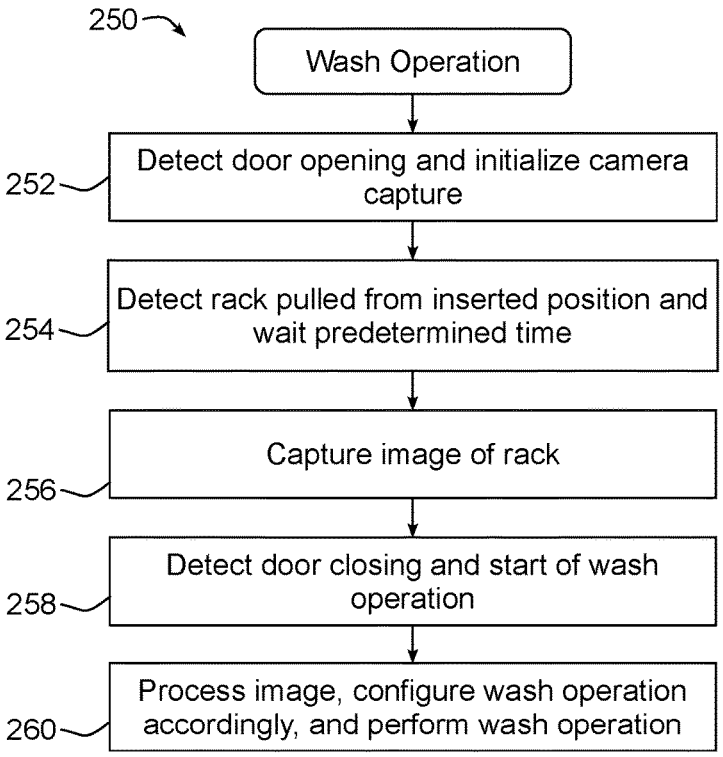
FIG. 6 is a flowchart illustrating an example sequence of operations for operating the dishwasher of FIG. 5.

FIG. 5 illustrates another example dishwasher 200 including a wash tub 202, a door 204, and upper and lower racks 206, 208. Upper rack 206 is mounted on extendible rails 210 and includes a plurality of wheels 212 that ride along rails 210. Lower rack 208 has a plurality of wheels 214 that generally support the rack on a ledge 216 defined on wash tub 202 and the inner surface of door 204. In this figure, upper rack 206 is illustrated in its extended position, while lower rack 208 is illustrated in its operative position.

Dishwasher 200 also includes a camera 218 that has a field of view oriented to capture an image of either rack 206, 208 when that rack is in its extended position. Furthermore, dishwasher 200 includes upper and lower sensors 220, 222 respectively configured to detect a position of racks 206, 208.

In the illustrated embodiment, each sensor 220, 222 is mounted on a wall of wash tub 202, and each is configured as a magnetic sensor, e.g., a hall effect sensor, and a corresponding magnetic member 224, 226, is disposed on a wheel 212, 214 of each rack 206, 208 and is positioned to oppose its respective sensor 220, 222 when its respective rack is at the operative position.

A wash operation may be performed in dishwasher 200, for example, using sequence of operations 250 performed by a controller (e.g., controller 30 discussed above) and illustrated in FIG. 6. First, in block 252, opening of the door may be detected, causing the sensors 220, 222 and the camera 218 to be initialized. At this time, camera 218 may begin capturing images and storing the images in a buffer.

Next, in block 254, either of racks 206, 208 is detected as being pulled away from (i.e., leaving) the operative position by the appropriate sensor 220, 222, which starts a timer to wait for a predetermined delay to allow for sufficient time for the rack to be fully pulled out to the extended position (e.g., a few seconds to even a few minutes). Then, in block 256, an image of the rack is captured responsive to this detection. It will also be appreciated that the sequence of blocks 254, 256 may be repeated multiple times, corresponding to the presence of multiple racks, as well as the possibility that a rack may be pulled out multiple times as additional utensils are added to both racks. In such instances, captured images may be maintained for both racks, and whenever a rack is extended, a newly captured image may replace the previously captured image for that rack, such that whenever a rack is pushed back into the wash tub, the most recent captured image for that rack is maintained.

Next, in block 258, closing of the door is detected along with a subsequent command to start the wash operation, and control passes to block 260. In block 260, the most recent captured image for each rack is processed to determine one or more of the quantity, type and/or locations of utensils in the rack, the wash operation is configured accordingly, and the wash operation is initiated and performed using the settings configured for the wash operation.

Figure 7:
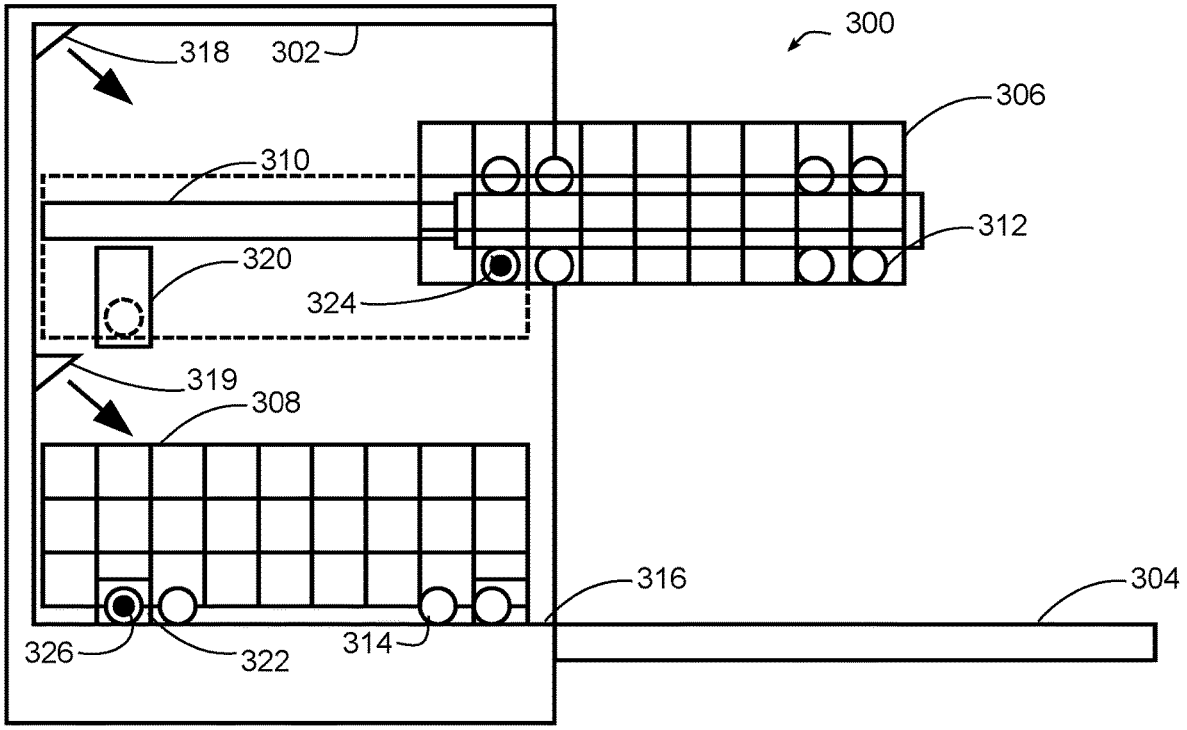
FIG. 7 is a functional side view of one example implementation of a dishwasher incorporating a rack sensor and camera configured to sense when a rack is at an operative position and capture an image of the rack when the rack is in the operative position, consistent with some embodiments of the invention.
Figure 8:
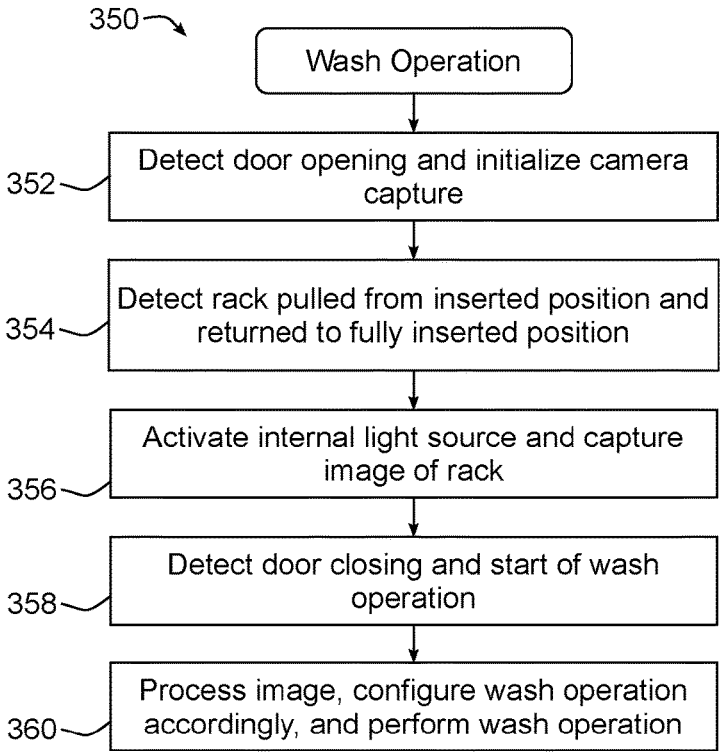
FIG. 8 is a flowchart illustrating an example sequence of operations for operating the dishwasher of FIG. 7.

FIG. 7 illustrates yet another example dishwasher 300 including a wash tub 302, a door 304, and upper and lower racks 306, 308. Upper rack 306 is mounted on extendible rails 310 and includes a plurality of wheels 312 that ride along rails 310. Lower rack 308 has a plurality of wheels 314 that generally support the rack on a ledge 316 defined on wash tub 302 and the inner surface of door 304. In this figure, upper rack 306 is illustrated in its extended position, while lower rack 308 is illustrated in its operative position.

Dishwasher 300 also includes a pair of cameras 318, 319, each of which having a field of view oriented to capture an image of a respective rack 306, 308 when that rack is in its operative position. Of note, while cameras 118, 218, 318, 319 are illustrated as being disposed on rear or top walls of a wash tub, it will be appreciated that an innumerable number of different locations could be used in other embodiments, including, for example, the door, the side walls or other structures in the dishwasher. Moreover, it will be appreciated that multiple cameras may be used in some embodiments to capture a rack from multiple angles. Further, a camera may include an integrated light source to illuminate an area to be captured in some embodiments, while in other embodiments, one or more light sources may be disposed in the wash tub to provide illumination.

Furthermore, dishwasher 300 includes upper and lower sensors 320, 322 respectively configured to detect a position of racks 306, 308. In the illustrated embodiment, each sensor 320, 322 is mounted on a wall of wash tub 302, and each is configured as a magnetic sensor, e.g., a hall effect sensor, and a corresponding magnetic member 324, 326, is disposed on a wheel 312, 314 of each rack 306, 308 and is positioned to oppose its respective sensor 320, 322 when its respective rack is at the operative position.

A wash operation may be performed in dishwasher 300, for example, using sequence of operations 350 performed by a controller (e.g., controller 30 discussed above) and illustrated in FIG. 8. First, in block 352, opening of the door may be detected, causing the sensors 320, 322 and the cameras 318, 319 to be initialized. At this time, cameras 318, 319 may begin capturing images and storing the images in a buffer.

Next, in block 354, either of racks 306, 308 is detected as being pulled away from (i.e., leaving) the operative position and then returning to that operative position by the appropriate sensor 320, 322. Then, in block 356, an image of the rack is captured responsive to this detection. In some embodiments, block 356 may also activate a light source in connection with capturing the image such that the rack is illuminated during the image capture (e.g., using an integrated light source for the camera or a separate light source disposed in the wash tub). It will also be appreciated that the sequence of blocks 354, 356 may be repeated multiple times, corresponding to the presence of multiple racks, as well as the possibility that a rack may be pulled out multiple times as additional utensils are added to both racks. In such instances, captured images may be maintained for both racks, and whenever a rack is extended, a newly captured image may replace the previously captured image for that rack, such that whenever a rack is pushed back into the wash tub, the most recent captured image for that rack is maintained.

Next, in block 358, closing of the door is detected along with a subsequent command to start the wash operation, and control passes to block 360. In block 360, the most recent captured image for each rack is processed to determine one or more of the quantity, type and/or locations of utensils in the rack, the wash operation is configured accordingly, and the wash operation is initiated and performed using the settings configured for the wash operation.

Figure 9:
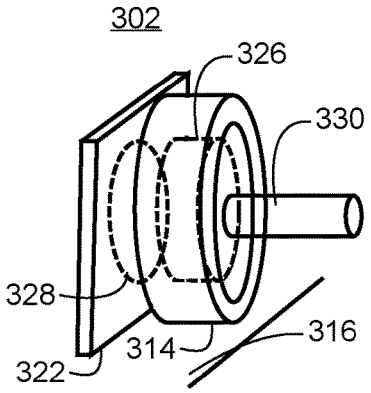
FIG. 9 is an enlarged perspective view illustrating the arrangement between a rack position sensor and a wheel of a rack in the dishwasher of FIG. 7.

FIG. 9 illustrates in greater detail an example arrangement between a magnetic element and a sensor for use in sensing the position of a rack. In particular, lower rack sensor 322 of dishwasher 300 of FIG. 7 is illustrated positioned on a side wall of wash tub 302 and proximate ledge 316 upon which the wheels 314 of the lower rack are supported (which may be connected, for example, through axles 330), and includes a sensing region 328. When a wheel 314 incorporating a magnetic member 326 is positioned adjacent sensing region 328, sensor 322 may detect the position of the rack. It will be appreciated that the illustrated arrangement is not the exclusive manner of sensing the position of a rack, so the invention is not limited to this particular arrangement.

Various modifications may be made to the illustrated embodiments without departing from the spirit and scope of the invention. For example, rather than hall effect sensors, other types of proximity sensors may be used, including mechanical switches, contact switches (e.g., to detect a conductive material on a rack, etc. In addition, in some embodiments, a camera may be active constantly, or at least after being initialized when a door is opened, and buffered such that when an image is captured, the capture may select from among multiple buffered images.

Additional modifications may be made to the illustrated embodiments consistent with the invention. Therefore, the invention lies in the claims hereinafter appended.

What is claimed is:

1. A dishwasher, comprising:

a wash tub;

a rack disposed in the wash tub and configured to support a plurality of utensils to be washed, the rack being movable between first and second positions, one of the first and second positions being an operative position at which the rack is positioned within the wash tub during washing and the other of the first and second positions being an extended position at which at least a portion of the rack is extended beyond the wash tub for loading or unloading of utensils;

a camera directed toward the rack when the rack is disposed in one of the first and second positions;

a sensor configured to detect when the rack is at one of the first and second positions; and a controller coupled to the camera and the sensor, the controller configured to detect that the rack is at one of the first and second positions using the sensor and in response thereto:

start a timer to wait for a predetermined delay to allow for sufficient time for the rack to be fully moved to the other of the first and second positions; and after expiration of the timer, cause the camera to capture an image of the rack;

wherein the controller is further configured to control one or more settings during a wash operation using the captured image.

2. The dishwasher of claim 1, wherein the rack has a range of travel, and wherein the first and second positions are disposed at opposite ends of the range of travel of the rack.

3. The dishwasher of claim 1, wherein the sensor comprises a magnetic sensor disposed on a wall of the wash tub.

4. The dishwasher of claim 3, wherein the magnetic sensor comprises a hall effect sensor.

5. The dishwasher of claim 3, wherein the rack includes a magnetic member disposed thereon and positioned to oppose the magnetic sensor at one of the first and second positions.

6. The dishwasher of claim 5, wherein the rack includes a plurality of wheels, and wherein the magnetic member is disposed on one of the plurality of wheels.

7. The dishwasher of claim 5, wherein the rack is height-adjustable between first and second heights, and wherein the magnetic sensor is dimensioned to detect the magnetic member when the rack is at each of the first and second heights.

8. The dishwasher of claim 1, wherein the sensor is a first sensor configured to detect when the rack is at the first position, and wherein the dishwasher further includes a second sensor configured to detect when the rack is at the second position.

9. The dishwasher of claim 1, wherein the rack is a first rack, wherein the sensor is a first sensor configured to detect when the first rack is at one of the first and second positions, and wherein the dishwasher further includes:

a second rack being movable between third and fourth positions, one of the third and fourth positions being an operative position at which the second rack is positioned within the wash tub during a washing operation and the other of the third and fourth positions being an extended position at which at least a portion of the second rack is extended beyond the wash tub for loading or unloading of utensils; and a second sensor configured to detect when the second rack is at one of the third and fourth positions.

10. The dishwasher of claim 1, further comprising a door closing the wash tub and a door switch configured to detect when the door is closed, wherein the controller is further coupled to the door switch to detect whether the door is closed and to activate the camera and the sensor in response to detecting that the door has been opened.

11. The dishwasher of claim 1, wherein the first position is the extended position, wherein the image is a first image, wherein the camera is directed toward the rack when the rack is disposed in the first position, wherein the sensor is configured to detect when the rack is at the first position, and wherein the controller is further configured to cause the camera to capture a second image of the rack in response to the sensor detecting that the rack is at the first position.

12. The dishwasher of claim 1, wherein the first position is the operative position and the second position is the extended position, wherein the image is a first image, wherein the camera is directed toward the rack when the rack is disposed in the second position, wherein the sensor is configured to detect when the rack is at the first position, and wherein the controller is configured to cause the camera to capture a second image of the rack in response to the sensor detecting that the rack is no longer at the first position.

13. The dishwasher of claim 1, wherein the first position is the operative position, wherein the image is a first image, wherein the camera is directed toward the rack when the rack is disposed in the first position, wherein the sensor is configured to detect when the rack is at the first position, and wherein the controller is configured to cause the camera to capture a second image of the rack in response to the sensor detecting that the rack is at the first position.

14. The dishwasher of claim 13, further comprising a light source disposed in the wash tub, and wherein the controller is configured to activate the light source to illuminate the wash tub when the camera captures the second image.

15. The dishwasher of claim 13, wherein the controller is further configured to cause the camera to capture the second image of the rack in response to detecting with the sensor that the rack has left the operative position and has thereafter returned to the operative position.

16. The dishwasher of claim 1, wherein the controller is configured to control the one or more settings during the wash operation by controlling one or more of a number of cycles, a cycle duration, a wash temperature, a cycle type, a spray direction, or a detergent amount.

17. The dishwasher of claim 1, wherein the image is a first image, and wherein the controller is configured to cause the camera to capture a second image in response to detecting with the sensor that the rack has entered the first or second position.

18. The dishwasher of claim 1, wherein the image is a first image, and wherein the controller is configured to cause the camera to capture a second image in response to detecting with the sensor that the rack has left the first or second position.

* * * * *